US011250821B2

(12) United States Patent
Klosowiak

(10) Patent No.: US 11,250,821 B2
(45) Date of Patent: Feb. 15, 2022

(54) LOW-VOLUME NECK BLOCK FOR SELECTIVELY RELEASABLE NECK ON A STRINGED INSTRUMENT

(71) Applicant: KLOS INNOVATIONS, LLC, Provo, UT (US)

(72) Inventor: Ian Klosowiak, Provo, UT (US)

( * ) Notice: Subject to any disclaimer, the term of this patent is extended or adjusted under 35 U.S.C. 154(b) by 0 days.

(21) Appl. No.: 16/572,485

(22) Filed: Sep. 16, 2019

(65) Prior Publication Data

US 2020/0111458 A1 Apr. 9, 2020

Related U.S. Application Data

(60) Provisional application No. 62/731,973, filed on Sep. 17, 2018.

(51) Int. Cl.
*G10D 3/06* (2020.01)
*G10D 3/22* (2020.01)

(52) U.S. Cl.
CPC ..... *G10D 3/06* (2013.01); *G10D 3/22* (2020.02)

(58) Field of Classification Search
CPC ..... G10D 3/06; G10D 3/22; G10D 3/095; G10D 1/08
See application file for complete search history.

(56) References Cited

U.S. PATENT DOCUMENTS 4,881,441 A * 11/1989 Larsen ..... G10D 3/02 84/291

* cited by examiner

*Primary Examiner* — Kimberly R Lockett
(74) *Attorney, Agent, or Firm* — Dax D. Anderson; Kirton McConkie

(57) ABSTRACT

An light weight injection molded neck block with stanchions that guide a bolts form the back of the body to the neck.

10 Claims, 9 Drawing Sheets

LOW-VOLUME NECK BLOCK FOR SELECTIVELY RELEASABLE NECK ON A STRINGED INSTRUMENT

TECHNICAL FIELD

The present disclosure relates generally to an injection molded neck block for use in string instruments.

BACKGROUND

Early historical evidence of a stringed instruments is found on tombs in ancient Egypt. Throughout history and into the present day stringed musical instruments continue to be popular. In the United States artists have used the guitar. Acoustic guitars are particularly popular in genres including Country, Folk, bluegrass and the like.

Acoustic instruments are widely used and admired because of their rich sound created by vibrating strings vibrating air in the resonating chamber. Guitars are played primarily by plucking or strumming. Other instruments, such as the violin, viola, cello and bass use a bow to create different sound based on similar technology. Even a piano operates by a vibrating string combined with a sound board.

Many traditions have arisen through time centered on musical instruments. From religious ceremonies to romanticized campfire sing-a-longs, accompanied vocals play an important part in society. As a result, musicians often want to bring their instruments on their travels. Guitar enthusiasts as well as professionals take their guitars wherever they go. Social media allows people to share talents and make more connections with people from around the world. When musicians make social media connections travel often is centered around traveling to meet new contacts to join in a jam session. In addition, with the improved mobility of electronics people have come to expect improved mobility in their other aspects of their lives including musical instruments.

The guitar is a mobile instrument and as a result, the weight of a guitar is important. Whether traveling or performing a lighter guitar gives advantages over heavier models. However, the materials inside a guitar's resonance chamber can materially affect the sound generated by the instrument. Traditional materials for guitars are based on natural fibers such as wood because of the belief that wood produces a richer sound. As a result guitar craftsman favor the use of wood and avoid the use of plastics in their manufacturing. A new neck block is needed to reduce the weight of the instrument and maximize the volume of the resonance chamber.

BRIEF SUMMARY

The general purpose of the systems and methods disclosed herein is to provide an improved neck block for a stringed instrument. Specifically, the improved neck block provides a reduced surface area which will reduce vibrational interference within the resonance chamber. In addition, the neck brace allows is configured to permit the easy selective removal of the neck from the resonance chamber body.

BRIEF DESCRIPTION OF THE DRAWINGS

In order to describe the manner in which the advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1A:
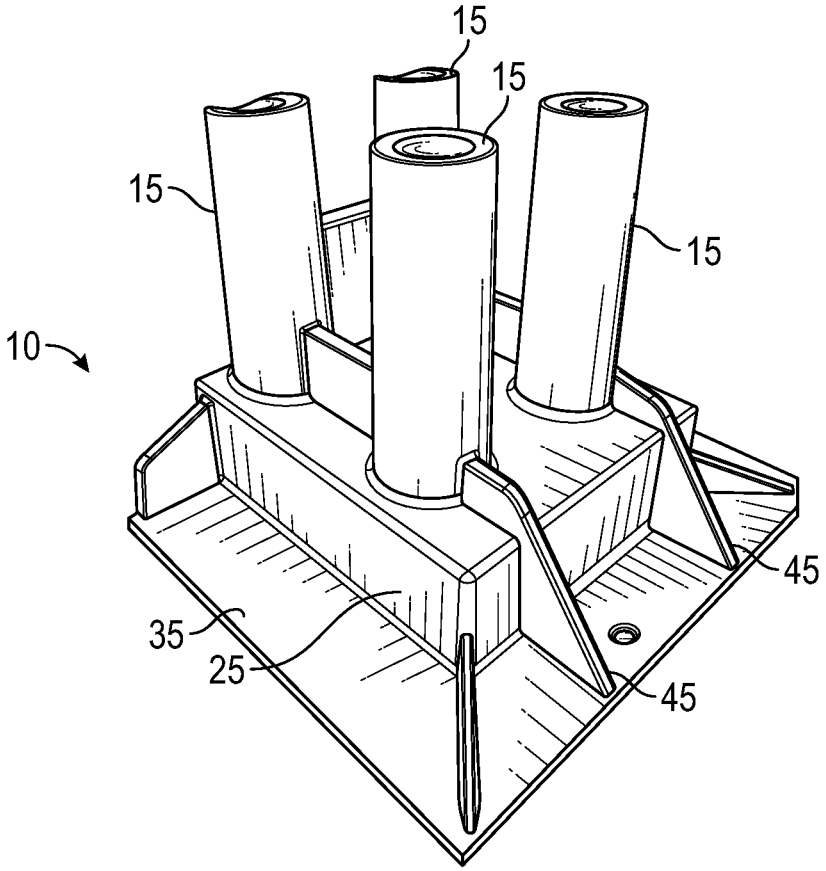
FIG. 1A shows a perspective view of the neck block.
Figure 1B:
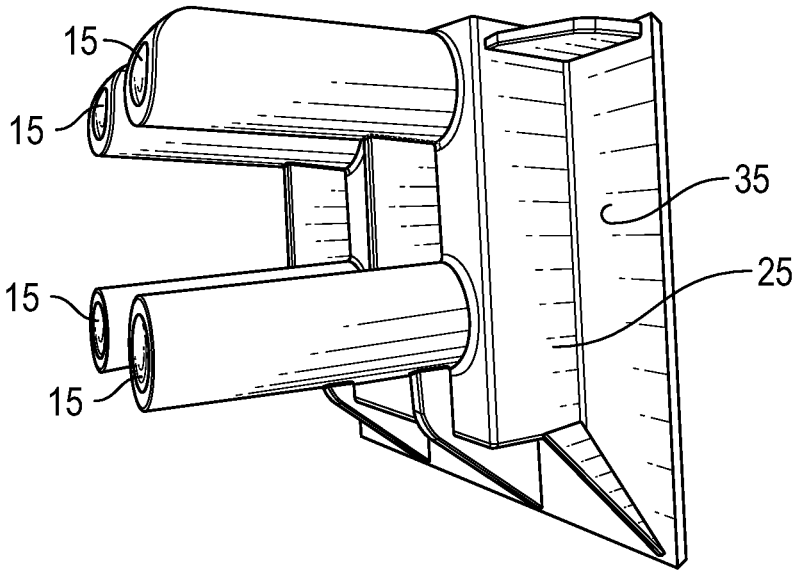
FIG. 1B shows a perspective view of the neck block.
Figure 1C:
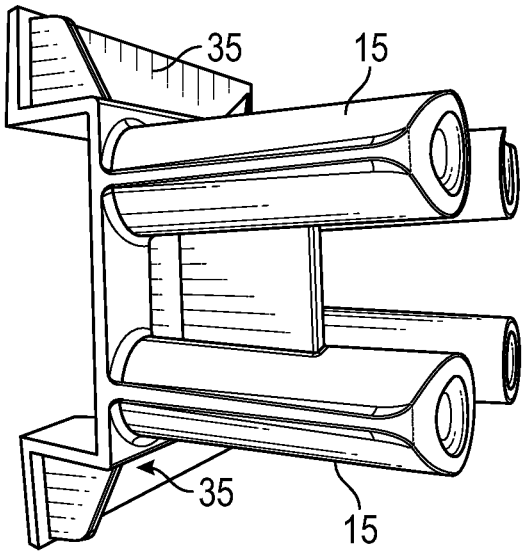
FIG. 1C shows a perspective view of the neck block.
Figure 1D:
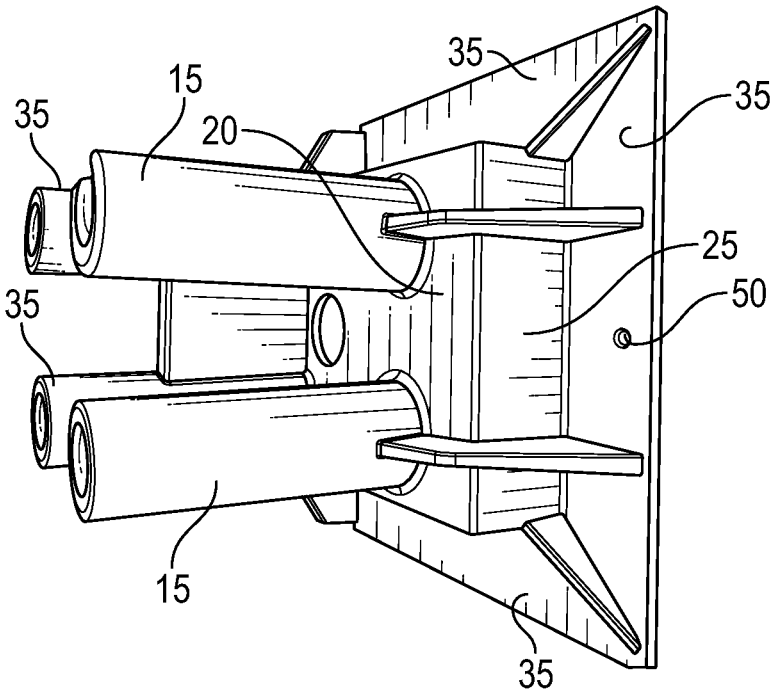
FIG. 1D shows a perspective view of the neck block.
Figure 1E:
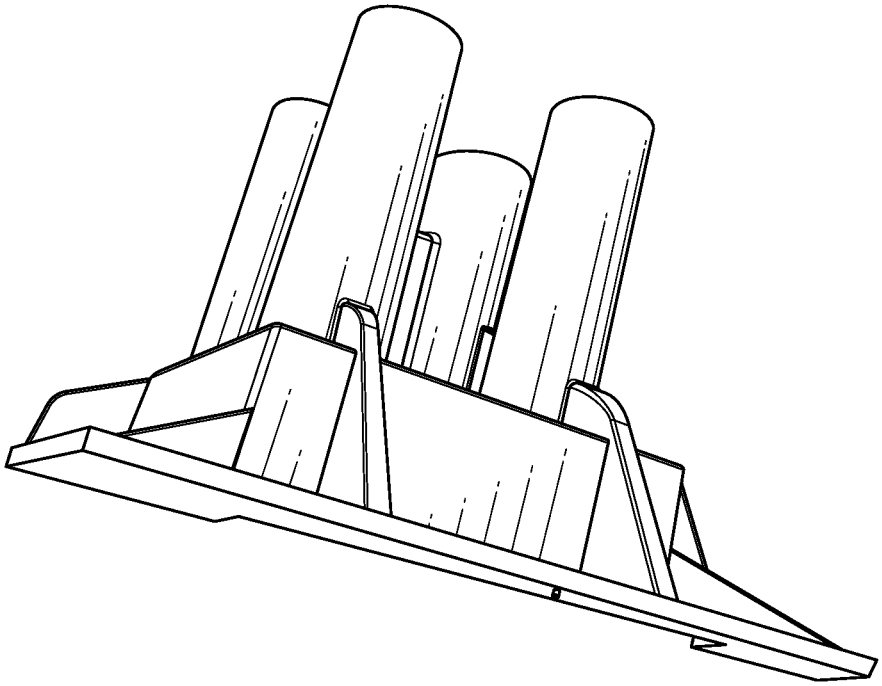
FIG. 1E shows a perspective view of the neck block.
Figure 1F:
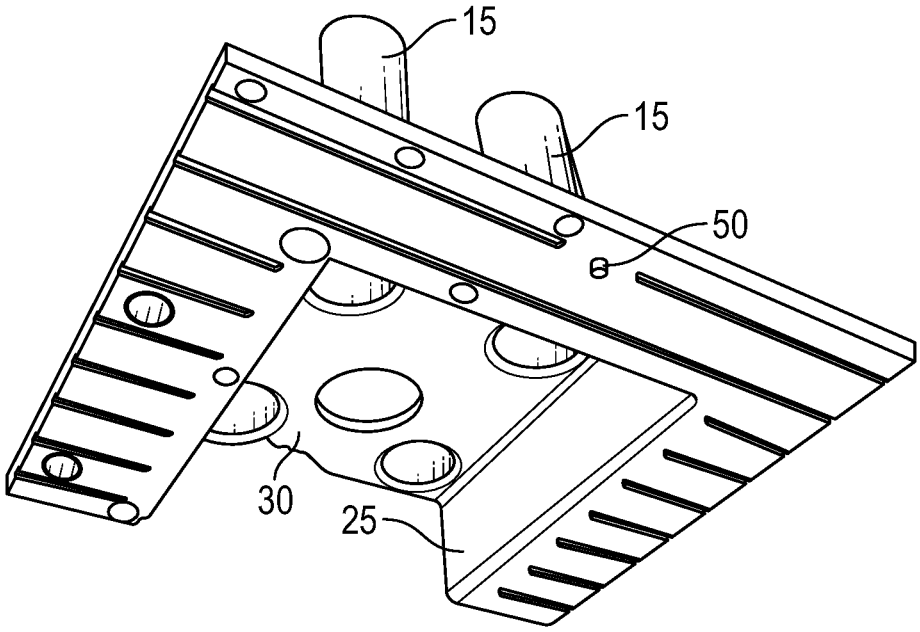
FIG. 1F shows a perspective view of the neck block.
Figure 2A:
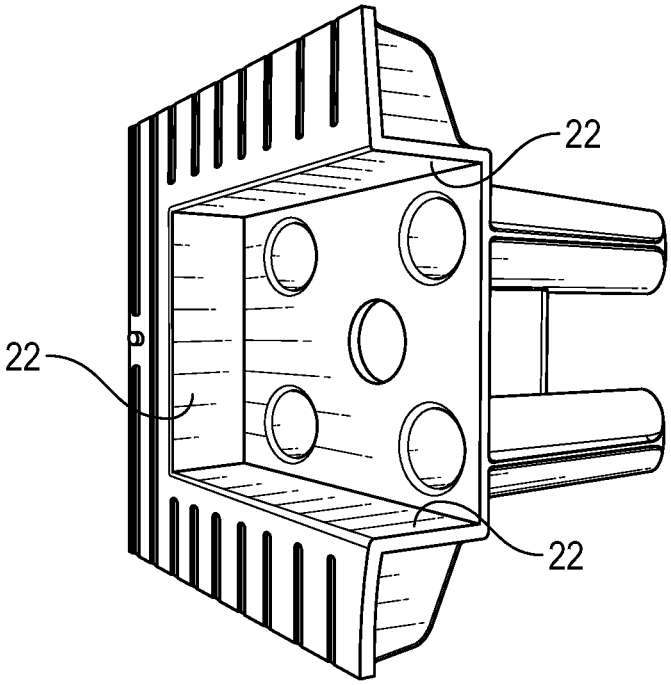
FIG. 2A shows a perspective view of the neck block.
Figure 2B:
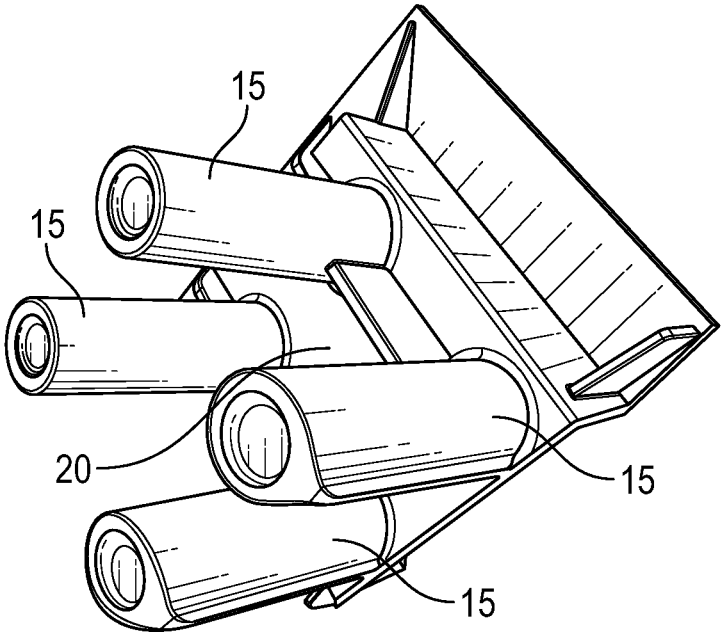
FIG. 2B shows a perspective view of the neck block.
Figure 2C:
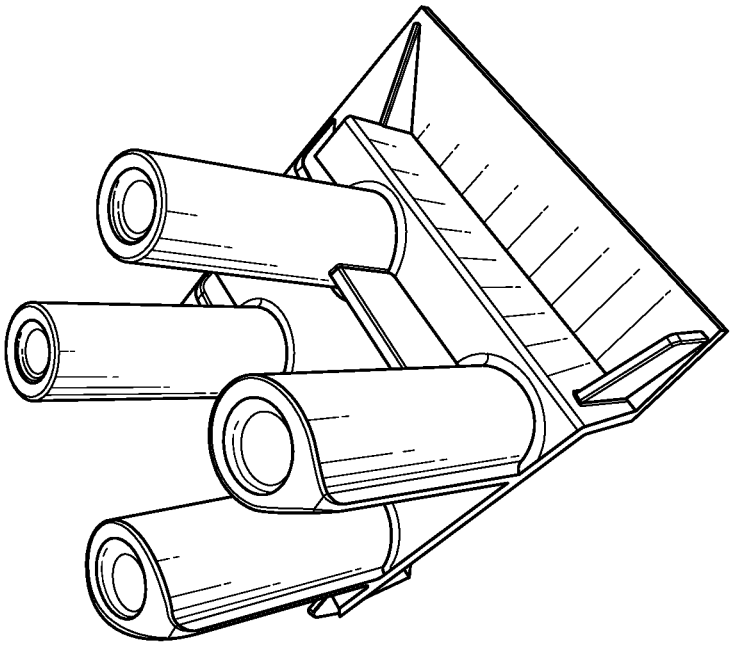
FIG. 2C shows a perspective view of the neck block.
Figure 2D:
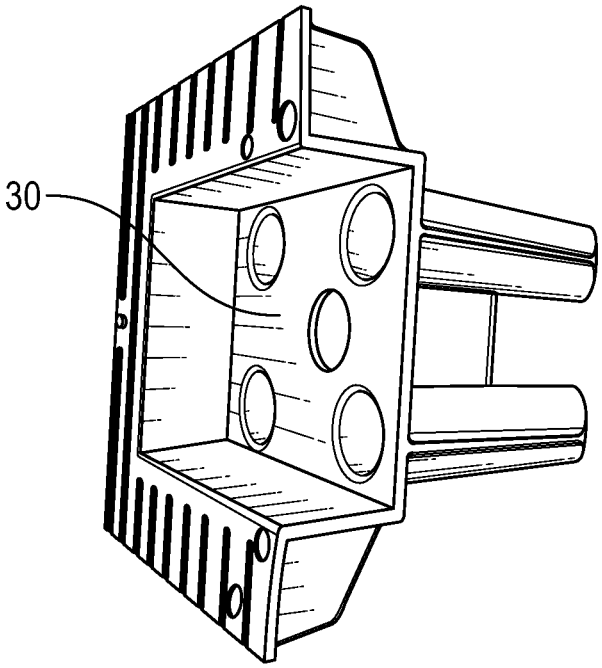
FIG. 2D shows a perspective view of the neck block.
Figure 2E:
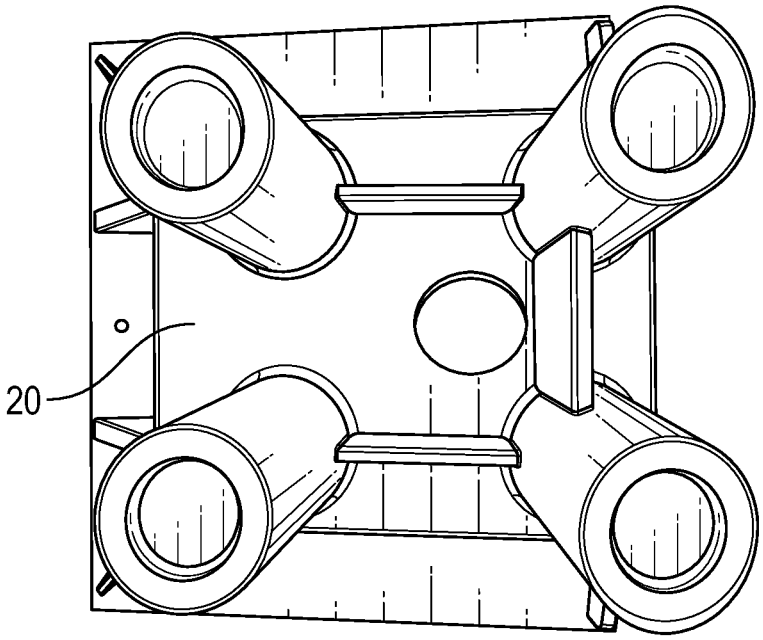
FIG. 2E shows a plan view of the neck block.
Figure 2F:
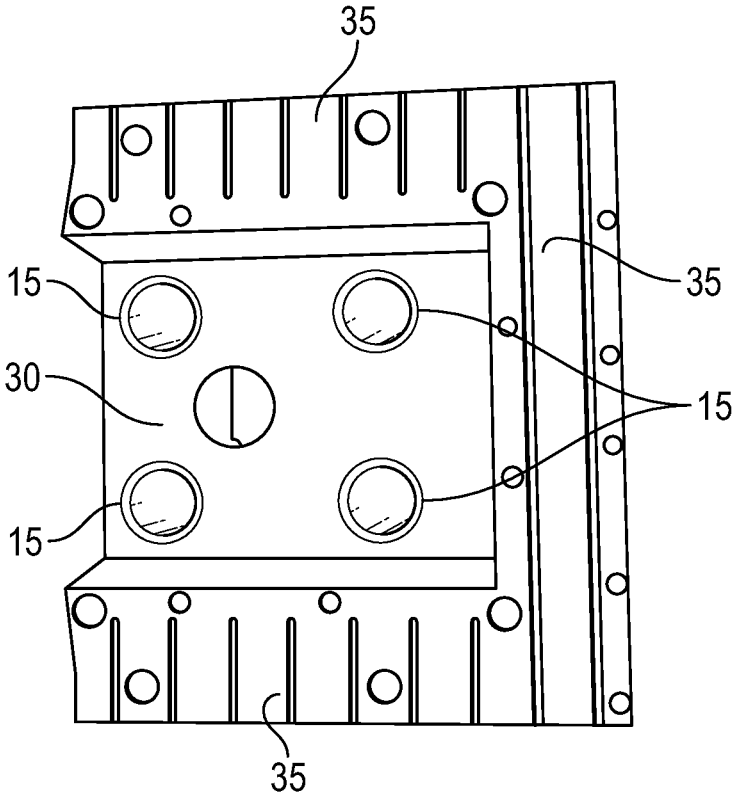
FIG. 2F shows a plan view of the neck block.
Figure 3A:
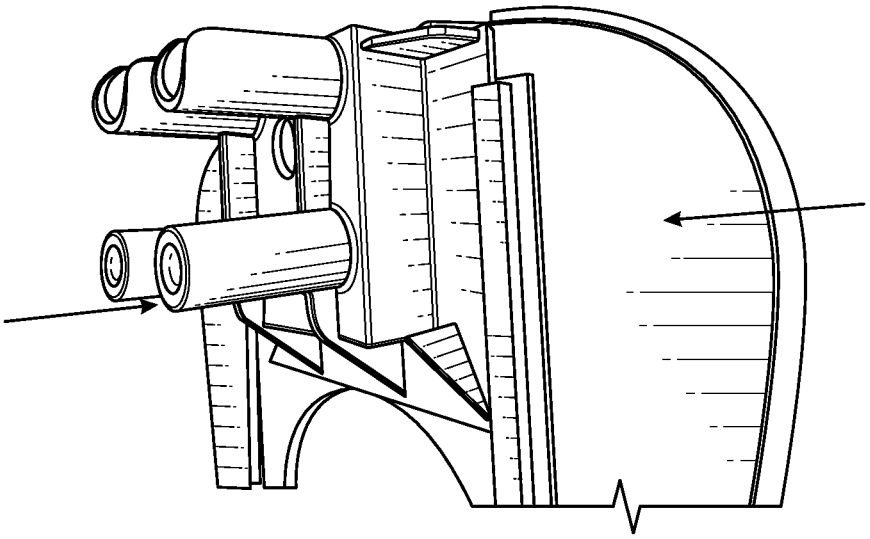
FIG. 3A shows a perspective view of the neck block installed on a sound board.
Figure 3B:
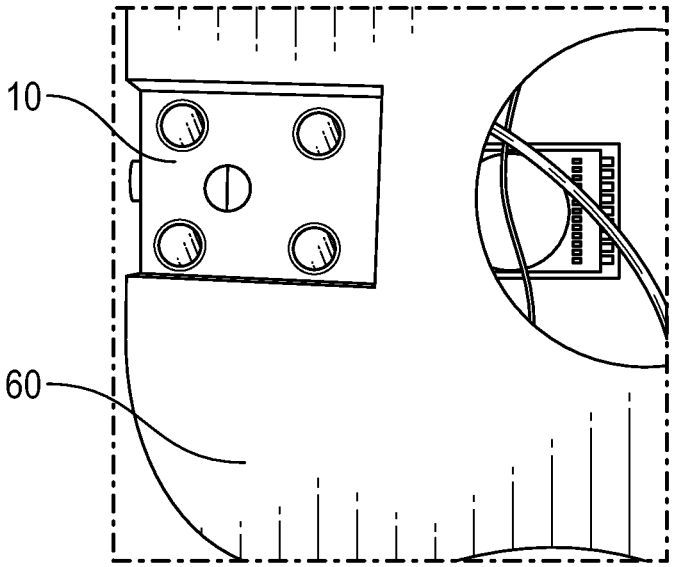
FIG. 3B shows an alternative perspective view of the neck block installed on a sound board with the neck removed.
Figure 3C:
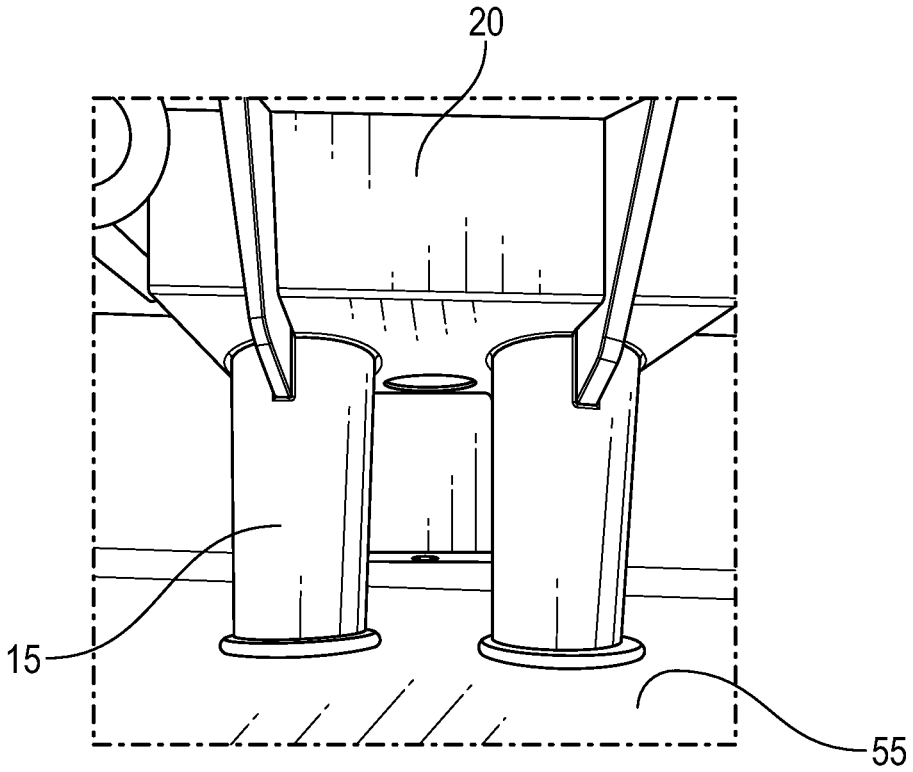
FIG. 3C shows an internal perspective view of the neck block installed in the resonance chamber of a stringed instrument.
Figure 3D:
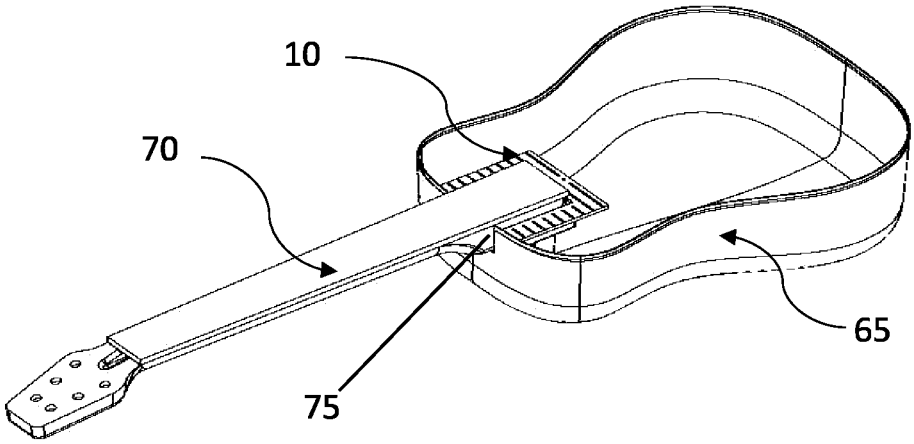
FIG. 3D shows a view of the neck block configured to receive a neck.
Figure 3E:
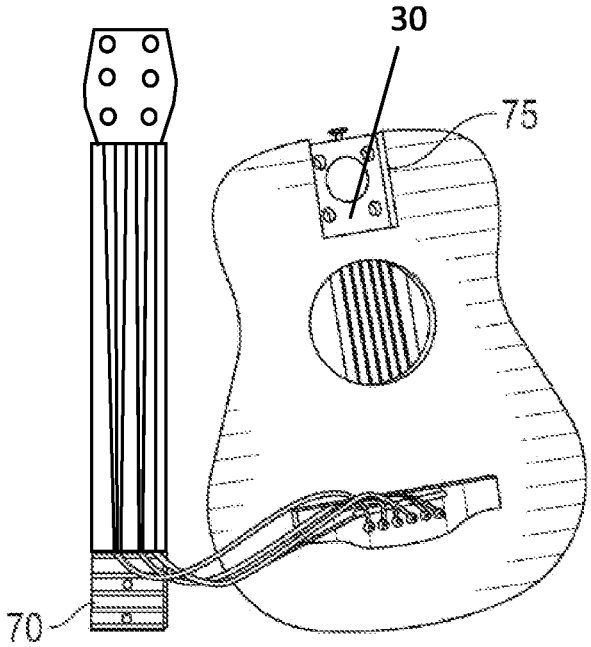
FIG. 3E shows a disassembled view of the neck block configured to receive a neck.

The present embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed descriptions of the embodiments of the apparatus, as represented in FIGS. 1-3C are not intended to limit the scope of the invention, as claimed, but are merely representative of alternative embodiments of the invention.

In general, a lightweight, minimized neck block 10 is disclosed. In certain embodiments the neck block 10 comprises a plurality of stanchions 15 which span between base 20 of the neck block 10 and the back 55 of the resonance chamber. In certain embodiments the stanchions 15 are geometrically shaped to produce the maximum strength for the minimum amount of materials. In certain embodiments the stanchions 15 are cylindrical, conical, rectangular or square. In certain embodiments the plurality of stanchions 15 is as few as 1 to as many as 10.

In certain embodiments the plurality of stanchions 15 extend from a base 20 and are configured to contact the surface of the resonance chamber opposite the sound board 60. The neck block 10 is oriented so the stanchions 15 align with a bolt pattern on the back 55 surface of a resonance chamber. In certain embodiments the stanchions 15 guide a bolt inserted through a hole on the back 55 of the resonance chamber through the resonance chamber and into the neck. In some embodiments the bolts securing the neck 70 to the body will be tightened and the neck 70 block 10 is configured to provide the necessary structural integrity to secure the neck 70 to the resonance chamber 65. The stanchions 15, as opposed to walls or other shapes are used to reduce the interference air vibrating inside the resonance chamber. In addition, the use of stanchions 15 with their minimal material and cross-sectional area, as opposed to other shapes, improves the transfer of neck vibrations to the resonance chamber, thus improving the timbre and sound color of the resonance chamber.

In some embodiments the stanchions 15 are hollow and configured to selectively receive a bolt therethrough. In certain embodiments, such as when the neck block 10 is installed, the stanchions 15 are configured to guide bolts through the back 55 wall of the resonance chamber and into the back of the neck.

In some embodiments the base 20 forms a shell 22 which comprises a receiving portion 30 configured to receive 75 a neck 70. In some embodiment the receiving portion 30 comprises a primary surface comprising the side opposite the point where the stanchions 15 joint the base 20. In some embodiments there primary surface further comprises a plurality of apertures in the primary surface configured to allow bolts to pass through the primary surface and screw into a neck 70. The receiving portion 30 further comprises a first side wall, a second side wall and a third side wall, each extending orthogonally from the primary surface away from the stanchions 15. In certain embodiments the second side wall, or the wall positioned in between the other two side walls meets the base surface in a right angle without a radius. Removing the radius improves the fit of the receiving portion and a neck when a neck 70 is inserted into the receiving portion. In certain embodiments the distal lip of the first second and third sidewalls form a flange 35 extending orthogonal the surface of the sidewalls. In some embodiments the first second and third side walls 25 extend a distance less than thickness of the neck 70 and when the flanges 35 are placed against a sound board 60, the neck block 10 is configured to receive 75 a neck 70. Finally, in certain embodiments the flanges 35 form a substantially planar surface which can be adhered to the back side of a sound board 60. In certain embodiments a set pin 50 is formed on the planar surface of the flanges 35 and can be used to properly position the neck block 10 on a surface of a body.

In certain embodiments the planar surface of the flanges 35 is glued to the sound bridge. In certain embodiments there are three flanges 35, two flanges 35 or a single flange. In some embodiments the neck block 10

In certain embodiments the neck block 10 is a single integrated piece which can be manufactured by injection molding, stamping or assembly of parts. Injection molding allows for the inexpensive accelerated production of the complex shape with stanchions 15, fins 45 and multiple orthogonal surfaces which comprises the neck block 10.

In certain embodiments the receiving portion 30 of the shell 22 is configured to receive the neck and be fasted to the body of the of the stringed instrument using the bolts and without any other materials, adhesives or securing mechanisms. In certain embodiments the receiving portion 30 or shell 22 is abutted in direct contact to the neck.

In certain embodiments the shell 22 of receiving portion 30 is configured to be in direct contact with the neck of a stringed instrument. Thus when a selectively removable neck is installed the neck is received in the receiving portion 30. When the neck is removed the receiving portion 30 of the neck block comprises the exterior surface of the body of the resonance chamber.

In certain embodiments the stanchions 15 are configured to guide a bolt through a resonance chamber of a stringed instrument to a selectively secureable neck.

In certain embodiments the sound board 60 is cut out is shaped to match the receiving portion 30 of the neck block 10 such that the back of the neck is nested in the receiving portion 30 of the neck block 10 while the fretted front of the neck is exposed for playing.

In certain embodiments the neck block 10 is oriented so as to place the plurality of stanchions in direct contact with the back 55 of the instrument resonance chamber while the shell 22 is in direct contact with the neck and the flange is in direct contact with the sound board 60 of the instrument. This configuration allows the neck to be selectively removed without undue burden and without special tools.

In certain embodiments an adhesive is used to attach the neck block to the resonance chamber. In some embodiments the adhesive is applied to the distal surfaces of the stanchions. The surfaces will be in contact with the back wall of a resonance chamber. In some embodiments an adhesive is applied to the flange surface and which is attached to a sound board in a resonance chamber. In some embodiments an adhesive is applied to the surface of the stanchions facing the receiving end of the receiving portion, where there is no side wall, The vibrational properties of the resonance chamber are improved by reducing the contact surface area between the neck block and the walls of the resonance chamber.

In closing, it is to be understood that the embodiments of the disclosure disclosed herein are illustrative of the principles of the present disclosure. Other modifications that may be employed are within the scope of the disclosure. Thus, by way of example, but not of limitation, alternative configurations of the present disclosure may be utilized in accordance with the teachings herein. Accordingly, the present disclosure is not limited to that precisely as shown and described.

The invention claimed is:

1. A neck block comprising:

a base;

a plurality of stanchions extending from a first side of the base;

a plurality of side walls extending from a second side of the base wherein the second side of the base and the plurality of side walls comprises a receiving portion shell configured to receive a neck of a stringed instrument;

a flange substantially coplanar with the base extending from the edge of the side walls; and a plurality of support fins extending from the base of the flange to the shell.

2. The neck block of claim 1 further comprising a set pin protruding from the flange configured to contact a soundboard.

3. The neck block of claim 1 wherein the neck block is formed by injection molding.

4. The stanchions of claim 1 wherein the stanchions are hollow and configured to selectively receive a bolt therethrough.

5. The receiving portion of claim 1 configured to selectively receive the neck of a stringed instrument.

6. The neck block of claim 1 wherein the the receiving portion shell is configured to be in direct contact with the neck of a stringed instrument.

7. The neck block of claim 1 wherein the stanchions are configured to guide a bolt through a resonance chamber of a stringed instrument to the neck.

8. The neck block of claim 1 wherein the end of the plurality of stanchions are configured to be in direct contact with the back of the stringed instrument while the flanges are in direct contact with a sound board of the stringed instrument.

9. The neck block of claim 1 wherein the fins are shorter than the stanchions.

10. The neck block of claim 1 wherein the receiving portion is configured to be exposed to the exterior of the resonance chamber when a neck of the stringed instrument is selectively removed.

* * * * *